US008397815B2

(12) United States Patent
MacDougall et al.

(10) Patent No.: US 8,397,815 B2
(45) Date of Patent: Mar. 19, 2013

(54) METHOD OF USING WIRED DRILLPIPE FOR OILFIELD FISHING OPERATIONS

(75) Inventors: Tom MacDougall, Sugar Land, TX (US); Gbenga Onadeko, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 285 days.

(21) Appl. No.: 12/870,972

(22) Filed: Aug. 30, 2010

(65) Prior Publication Data

US 2012/0048552 A1 Mar. 1, 2012

(51) Int. Cl.
*E21B 31/00* (2006.01)

(52) U.S. Cl. ..... 166/301; 166/99

(58) Field of Classification Search ..... 166/301, 166/98, 99

See application file for complete search history.

(56) References Cited

U.S. PATENT DOCUMENTS

| | | | | |
|---|---|---|---|---|
| 2,745,693 | A | 5/1956 | McGill | |
| 2,970,859 | A | 2/1961 | Justice | |
| 3,191,981 | A | 6/1965 | Osmun | |
| 4,061,389 | A | 12/1977 | Keller et al. | |
| 4,877,085 | A | 10/1989 | Pullig, Jr. | |
| 5,477,921 | A | 12/1995 | Tollefsen | |
| 6,641,434 | B2 | 11/2003 | Boyle et al. | |
| 6,866,306 | B2 | 3/2005 | Boyle et al. | |
| 7,413,021 | B2 | 8/2008 | Madhavan et al. | |
| 7,617,873 | B2 | 11/2009 | Lovell et al. | |
| 7,874,364 | B2 * | 1/2011 | Redlinger et al. | 166/301 |
| 2009/0166087 | A1 | 7/2009 | Braden et al. | |
| 2011/0088903 | A1 * | 4/2011 | Onadeko et al. | 166/301 |

OTHER PUBLICATIONS

Underhill, W.B. et al., Model-Based Sticking Risk Assessment for Wireline Formation Testing Tools in the U.S. Gulf Coast, SPE 48963, New Orleans, LA, Sep. 27-30, 1998.

* cited by examiner

*Primary Examiner* — William P Neuder
(74) *Attorney, Agent, or Firm* — Kimberly Ballew

(57) ABSTRACT

A method and apparatus for fishing a wellbore with wired drill pipe are provided. Embodiments of the invention advantageously identify objects for removal and signal proper attachment therewith. In an embodiment, a method of fishing with wired drill pipe comprising attaching a fishing apparatus to the end of a wired drill pipe string, extending the wired drill pipe string into a wellbore, monitoring signals received through the wired drill pipe string from one or more sensors coupled to the fishing apparatus, and determining proper coupling of the fishing apparatus with one or more objects intended for removal based on the signals received from the sensors is provided.

20 Claims, 7 Drawing Sheets

METHOD OF USING WIRED DRILLPIPE FOR OILFIELD FISHING OPERATIONS

BACKGROUND OF THE INVENTION

Description of the Related Art

At times, well logging and well forming tools may become detached, stuck, or broken, for example, within a wellbore. In an oilfield, the retrieval of tools, as well as other objects which may enter the wellbores, may need to be conducted from time to time in order to allow well forming and well logging operations to continue efficiently. This retrieval process is often referred to as "fishing" in the wellbore. Additionally, the rigs used for the well logging and well forming operations often contain objects which may fall into the wellbore. These objects may include, for example, articles of clothing and hand tools.

Current methods and devices for fishing are incapable of signaling that objects or tools being fished for have been found and properly attached to the retrieval equipment. Tools created for the retrieval of misplaced tools and objects, as well as unwanted debris, simply travel the wellbore in an attempt to gather everything with no indication that all of the objects have been found and collected. Additionally, during fishing operations, logging of the wellbore may be put on hold. Since fishing operations may last for extended periods of time, many opportunities for logging the wellbore may be missed.

When a tool, such as a well logging tool, becomes stuck in a wellbore, several events may occur. For example, the cable, such as a wireline, connecting the tool with the surface may be entirely intact and connected to the tool and the surface, the cable may break near the surface and still be connected to the tool, or the cable may break near the tool. In the case when the cable has broken, communication with the tool may no longer be possible and therefore any further measurements taken by the device are lost.

Therefore, a method and apparatus for efficiently sensing and gathering objects from a wellbore are needed. Also, a method and apparatus for logging the wellbore while fishing are needed.

BRIEF DESCRIPTION OF THE DRAWINGS

So that the manner in which the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present inventions generally relate to apparatus and methods for retrieving ("fishing") tools or other unwanted items from an oilfield wellbore using wired drill pipe having tools connected thereto.

Figure 1:
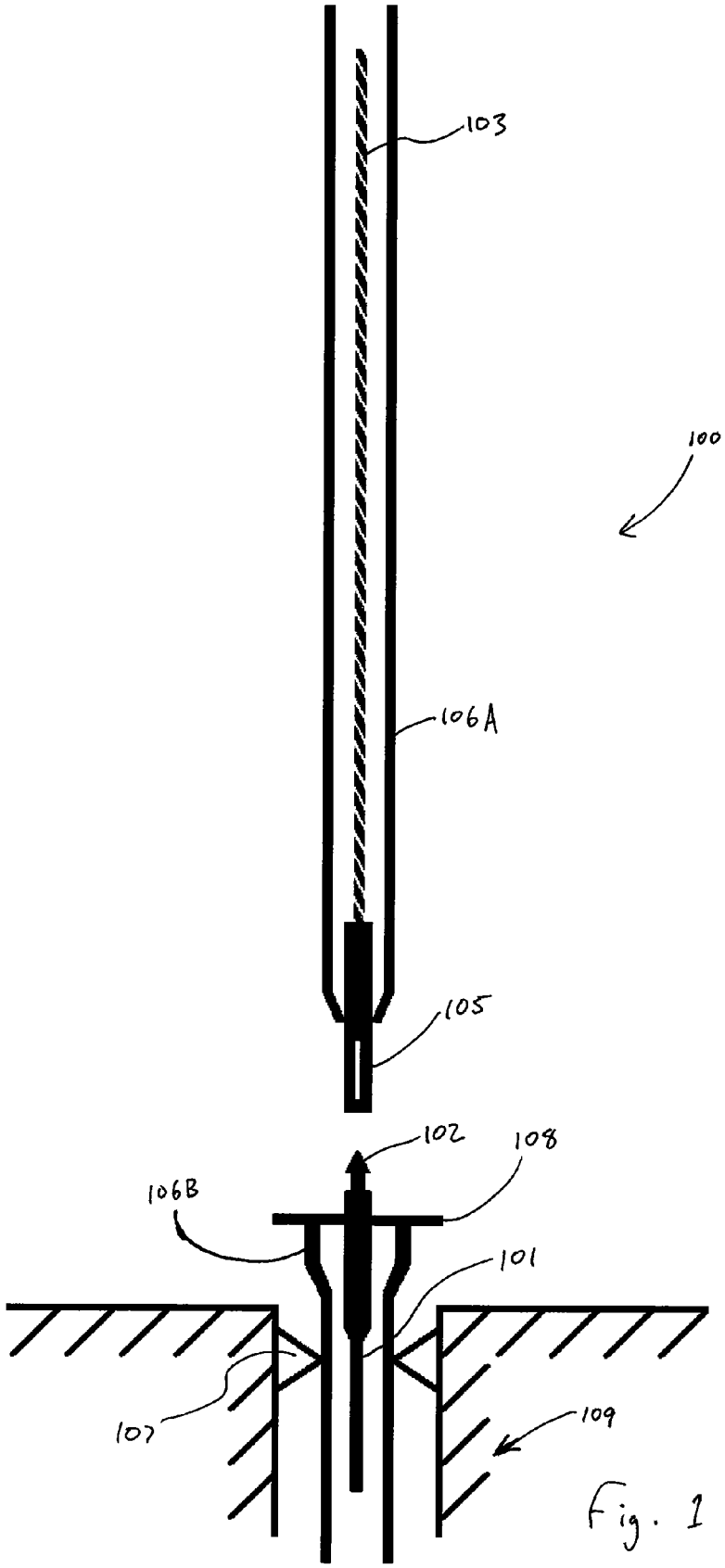
FIG. 1 is a partial cross sectional view of an embodiment of a wired drill pipe and a pipe threading apparatus.

FIG. 1 shows an embodiment of a drill pipe threading apparatus 100 which may be used to thread a cable 101, such as a wireline, a slickline or other cable providing data and/or power communication, through a drill string, such as the drill pipe sections 106A and 106B. In an embodiment, the drill pipe sections 106A and 106B may be wired drill pipe. Wired drill pipe in general may be a drill pipe which has an internal communication channel connected to communication elements in the box and pin ends of the drill pipe. The communication element, such as an inductive or flux coupler, of each pipe may communicatively couple with the communication elements of other wired drill pipes to create a communication channel along a whole string of wired drill pipe. The communication elements may also be used to communicatively couple with surface components and downhole tools. Examples of wired drill pipe that may be used in the present disclosure are described in detail in U.S. Pat. Nos. 6,641,434 and 6,866,306 to Boyle et al. and U.S. Pat. No. 7,413,021 to Madhavan et al. and U.S. Patent App. Pub. No. 2009/0166087 to Braden et al., assigned to the assignee of the present application and incorporated by reference in their entireties.

The drill pipe threading apparatus 100 may generally consist of a spearhead sub 102, a cable 103, and a spearhead overshot 105. The plurality of wired drill pipe sections 106A and 106B may be coupled together to form a wired drill pipe string which may have a fishing apparatus, for example a tool overshot 201 shown in FIG. 2A, coupled to the end for retrieving a cable conveyed tool string 200. The tool string 200 shown in FIG. 2A may be lost or stuck, such as being caught in a crack, wedged to the wellbore wall by debris, stuck due to a pressure differential or may be stuck or otherwise irretrievable for any other reason that will be appreciated by those having ordinary skill in the art. The threading apparatus 100 may be useful when the cable 101 is still connected to both the surface and the stuck tool or the cable 101 has a sufficient length to be retrieved by a cable fishing apparatus, for example a wireline grapple 300 shown in FIG. 3. Threading of the wired drill pipe string may assist in guiding the fishing tool to the tool string 200 which may be lost downhole. The cable 101 may be coupled to the spearhead sub 102 for facilitating threading of the cable 101 through the wired drill pipe sections 106A and 106B. The cable 103 may have one end connected to a pipe elevator of a drill rig (not shown) and the other end may be coupled to the tool overshot 201.

The spearhead overshot 105 may be fed through the wired drill pipe section 106A. A previously threaded wired drill pipe section 106B may be wedged in place above the wellbore 109 using slips 107 or other device to clamp the drill string, while a spearhead sub 102 may be held in place with a clamp 108, such as a c-plate. The spearhead overshot 105 may be coupled with the spearhead sub 102. The clamp 108 may be removed and the spearhead overshot 105 may hold the spearhead sub 102 while the wired drill pipe section 106A may be coupled to the previously threaded wired drill pipe section 106B. The slips 107 may be loosened and the newly threaded wired drill pipe section 106A may be lowered into the wellbore 109. The wired drill pipe section 106A may then be wedged in place using the slips 107. The spearhead sub 102 may be pulled through the wired drill pipe section 106A by pulling up on the cable 103 with the pipe elevator (not shown). The spearhead sub 102 may be brought to the end of the wired drill pipe section 106A and held in place with the use of the clamp 108. The spearhead overshot 105 may then decouple from the spearhead sub 102. The steps described above may be repeated until a string of wired drill pipe sections 106A, 106B is created. The string of wired drill pipe sections 106A, 106B may be guided by the cable 101 to the stuck tool string 200.

Figure 2A:
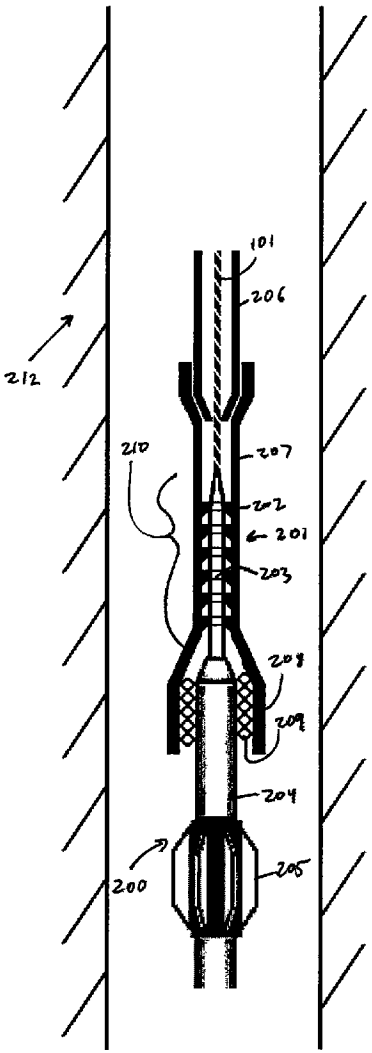
FIG. 2A is a partial cross sectional view of an embodiment of a tool overshot with conductive pads.
Figure 2A:
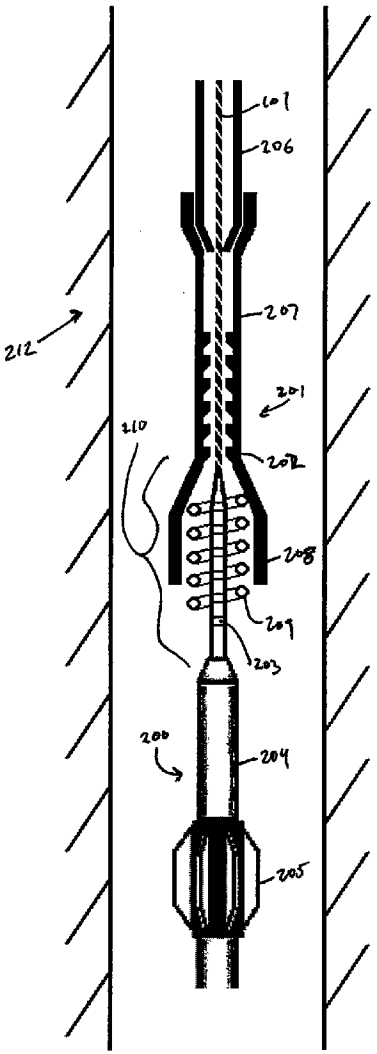

FIG. 2A illustrates embodiments of a tool overshot 201 having conductive pads 202 to sense connection with a tool string 200 which may be lost or stuck in a wellbore 212. The tool string 200 may generally include one or more tools 204 which may be coupled in an assembly, one or more centralizers 205 positioned along the tool string 200, a spear section 210, and one or more conductive contacts 203. The one or more tools 204 may measure a property of the wellbore 212, a formation about the wellbore 212, and/or the drill string. In an embodiment, the tools 204 may be well logging tools, such as for example formation evaluation tools, formation sampling tools, and/or well completion tools, such as for example perforating tools. The formation evaluation tools may include, but are not limited to, induction resistivity instruments, gamma ray sensors, formation fluid sampling devices (which may include fluid pressure sensors). The one or more centralizers 205 may be adapted to provide a standoff distance from the wellbore wall and the tool string 200. The spear section 210 may be coupled to the end of the cable 101 and the top of the tool string 200. The conductive contacts 203 may be a conductive material linearly spaced and wrapped around the spear section 210. The conductive contacts 203 may be communicatively coupled with the one or more tools 204, the cable 101, or both, and adapted to communicatively couple with the conductive pads 202 of the tool overshot 201.

The cable 101 may be fed through a number of wired drill pipes 206, as described above, and the resulting wired drill pipe string may be coupled with the tool overshot 201. The tool overshot 201 comprises a conductive grapple assembly including a body 207, a head section 208, the conductive pads 202, and a grapple mechanism 209. Examples of the grapple mechanism are shown and described in U.S. Pat. Nos. 2,970,859; 3,191,981; 2,745,693; and 4,061,389; 4,877,085, which are incorporated by reference in their entirety. In an embodiment, the grapple mechanism 209 may be sized and shaped like a loosely wound spring that may grab the tool 204 of the tool string 200 that is connected to the spear section 210. The grapple mechanism 209 may have an internal diameter that is smaller than an external diameter of the tool 204 when in an uncompressed state. In an embodiment, as the tool string 200 is inserted into the tool overshot 201, the grapple mechanism 209 may be compressed as it is forced against an upper surface of the tool 204. In another embodiment, an actuator (not shown) may be coupled with grapple mechanism 209 to compress the grapple mechanism 209. During this compression, the internal diameter of the grapple mechanism 209 may increase until the internal diameter of the grapple mechanism 209 is the same or larger than the external diameter of the tool 204. The tool string 200 may be more easily inserted into tool overshot 201 by compressing the grapple mechanism 209 with the actuator, to increase the internal diameter of the grapple mechanism 209, prior to insertion of the tool string 200 into the tool overshot 201. The actuator may be released once the tool string 200 is inserted to allow the grapple mechanism 209 to grapple the tool 204. Friction between the grapple mechanism 209 and the tool 204 retains the tool string 200 within the tool overshot 201. The friction between the tool 204 and the grapple mechanism 209 increases as the tool string 200 pulls against the grapple mechanism 209 during removal of the tool string 200 from its stuck position. As the tool string 200 pulls against the grapple mechanism 209, tension is created in the grapple mechanism 209 which forces the grapple mechanism 209 to try and lengthen and consequently decrease in diameter. However, since the grapple mechanism 209 is wrapped around the tool 204 the grapple mechanism 209 cannot decrease in diameter and therefore extra pressure is applied to the tool 204 instead.

The body 207 of the tool overshot 201 may be shaped to match a contour of the spear section 210 to ensure proper alignment of the tool string 200 with the tool overshot 201. The spear section 210 may be further adapted to assist in guiding the tool string 200 into the tool overshot 201. A tapering upper end of the spear section 210 may contact an inner portion of the head section 208, thereby urging the spear section 210 toward the center of the tool overshot 201. The spear section 210 may then enter the body 207. The conductive pads 202 may be linearly spaced along the body 207 at intervals corresponding with the conductive contacts 203. When the spear section 210 is fully inserted into the tool overshot 201 the conductive pads 202 and conductive contacts 203 are aligned. The conductive pads 202 may be communicatively coupled with the communication channel of the wired drill pipe string. The tool overshot 201 may be lowered until a receiver (not shown) connected to the top of the wired drill pipe string, consisting of the wired drill pipe sections 206, senses a connection between the conductive pads 202 and one or more conductive contacts 203. In an embodiment, communicating and receiving signals through the wired drill pipes 206 with the tool string 200 may indicate proper connection with the tool string 200. The tool string 200 may be removed from the wellbore 212 once coupled with the tool overshot 201.

Figure 2B:
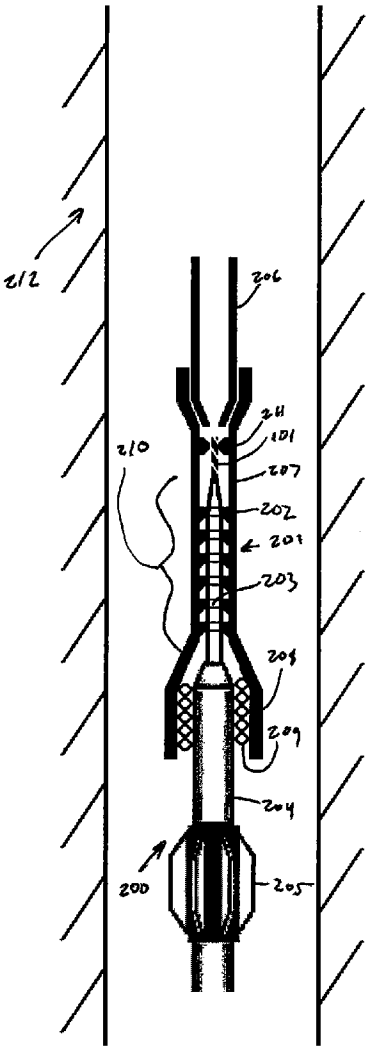
FIG. 2B is a partial cross sectional view of another embodiment of a tool overshot.
Figure 2B:
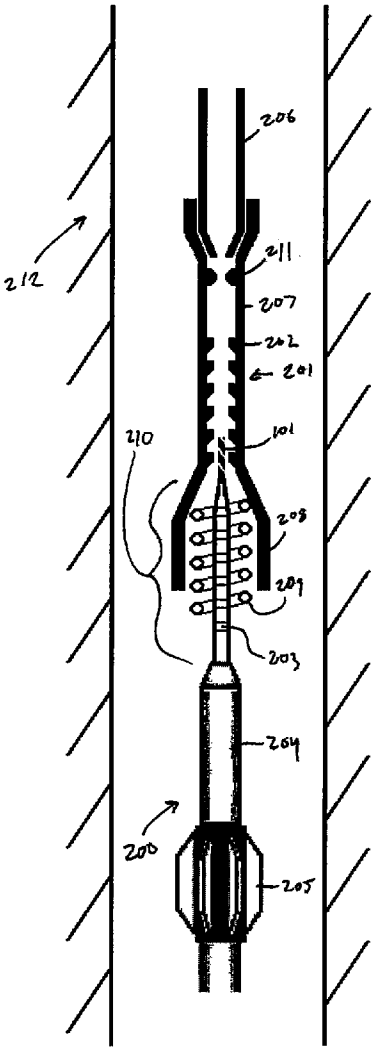

FIG. 2B illustrates an embodiment of the tool overshot 201 being used to locate the tool string 200 when the cable 101 has been broken. In such a situation, the cable may be too short to be retrieved and threaded as shown in FIG. 1. Threading of the cable 101 through the wired drill pipes 206 allows the tool overshot 201 to be guided to the tool string 200. If threading of the cable 101 is not possible then sensors coupled to the tool overshot 201 and wired drill pipes 206 may need to be relied upon for efficiently locating the tool sting 200. Therefore, in order to efficiently fish for the tool string 200, the conductive pads 202 of the tool overshot 201 may be used to verify proper insertion of the tool string 200 into the tool overshot 201 as described above for FIG. 2A. In another embodiment, verifying insertion of the tool string 200 into the tool overshot 201 may be accomplished by sensing connection between a corresponding number of the conductive pads 202 and conductive contacts 203. For example, if there are six conductive pads 202 and six corresponding conductive contacts 203, verifying complete insertion of the tool string 200 into the tool overshot 201 may be established by sensing six connections between the conductive pads 202 and conductive contacts 203.

In another embodiment, a fluid pressure sensor 211 may be coupled to the tool overshot 201. The fluid pressure sensor 211 may be used to measure the pressure of fluid within the tool overshot 201. An increase in pressure sensed by the fluid pressure sensor may indicate proper insertion of the tool string 200 into the tool overshot 201. In another embodiment, a strain gauge (not shown) may be coupled with the grapple mechanism 209 of the tool overshot 201. The strain gauge may be used to sense connection with the tool string 200. A sufficient increase in strain shown by the strain gauge during extraction of the tool string 200 may indicate that the tool string 200 has been properly coupled with the tool overshot 201 and is being carried out of the wellbore 212. In another embodiment, a sonar camera may be used to determine coupling of the tool overshot 201 with tool string 200.

The process of verifying insertion of the tool string 200 into the tool overshot 201 described above may decrease the time spent retrieving the stuck tool string 200. In an embodiment, the tool string 200 may contain well logging tools. Signals cannot be communicated from the tool string 200 to the surface through the broken cable 101, and it may therefore be beneficial to transmit signals from the tool string 200 through the wired drill pipes 206 instead. Signals from the tool string 200 may be transmitted from the conductive contacts 203 to the conductive pads 202. The signals may then be transmitted up the wired drill pipe string to a surface component. In this embodiment, well logging measurements may be obtained by the tool string 200, and transmitted to the surface to be recorded, while the tool string 200 is being removed from the wellbore 212. This may be beneficial since the downtime in measurement acquisition will be reduced. Additionally, a diagnosis of the event which caused the tool string 200 to become stuck downhole may be determined from measurements taken by the tool string 200, and possible reasons for the tool string 200 becoming stuck may be discovered. Such measurements may include detecting wellbore irregularities, such as wash-out, mud-cake quality or mud invasion of the formation, wellbore and formation pressure, and wellbore diameter changes, among others.

Figure 3:
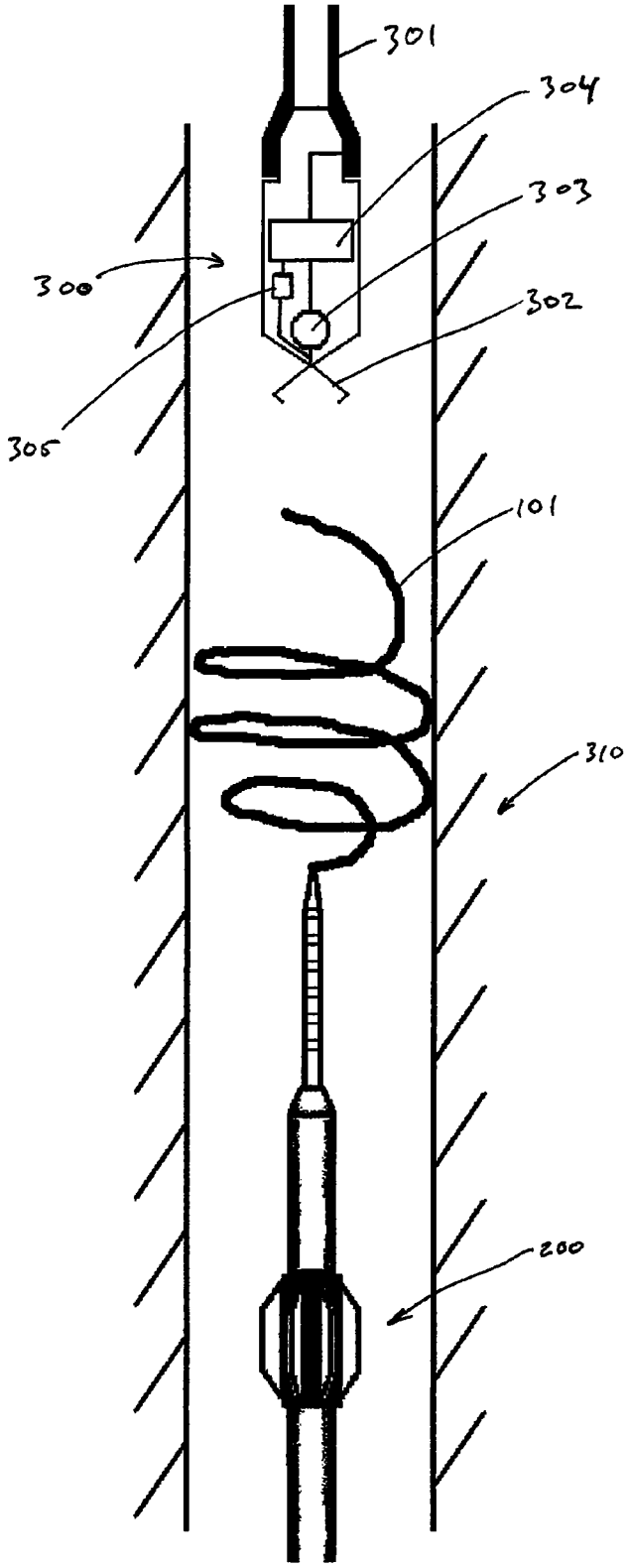
FIG. 3 is a partial cross sectional view of an embodiment of a wireline grapple.

FIG. 3 illustrates a partial cross section of an embodiment of a wireline grapple 300 which may be used to retrieve a cable 101 connected to a stuck tool string 200. As shown, the cable 101 has broken with sufficient length to be retrieved. The wireline grapple 300 may be extended down a wellbore 310 on a wired drill pipe string 301 in order to retrieve the cable 101. The wireline grapple 300 may include a grapple mechanism 302, a motor 303 to drive and operate the grapple mechanism 302, and a relay 304 which may be used to operate the motor and one or more sensors 305 coupled to the wireline grapple 300. The relay 304 may be communicatively coupled with the wired drill pipe string 301 in order to send and receive signals with a surface component. In an embodiment, the one or more sensors 305 may include a conductive sensor, coupled with the wireline grapple 300, to sense when a conductive material, such as the broken cable 101, is in contact with the grapple mechanism 302. Once the conductive sensor senses contact with the cable 101, a signal may be sent to the relay 304 which may activate the motor 303, thereby closing the grapple mechanism 302. In another embodiment, the grapple mechanism 302 may be closed automatically by the relay 304 when conductive contact is sensed. The one or more sensors 305 may also include a pressure sensor, coupled with the wireline grapple 300, which may indicate when sufficient grappling pressure is created between the grapple mechanism 302 and the cable 101 to lift the cable 101 back to the surface. The wireline grapple 300 may additionally be rotated in order to wrap a section of the cable 101 around the grapple mechanism 302, which may increase the grip of the grapple mechanism 302 on the cable 101.

Figure 4:
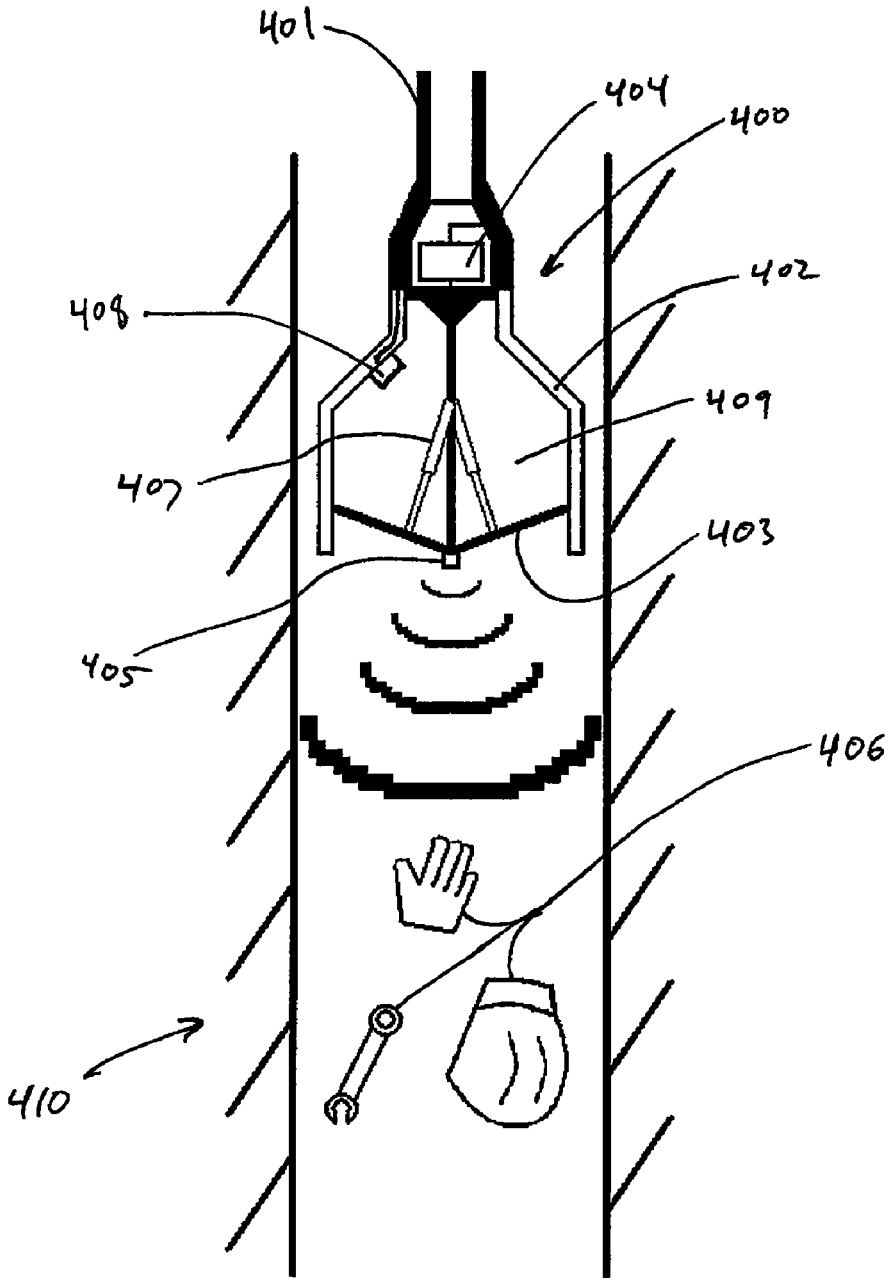
FIG. 4 is a partial cross sectional view of an embodiment of a debris removal mechanism.

FIG. 4 illustrates a partial cross section of an embodiment of a debris removal mechanism 400 coupled to a wired drill pipe string 401. The debris removal mechanism 400, also referred to as a "junk basket", may include an outer wall 402 which may define an internal volume 409. The perimeter of the outer wall 402 may be polygonal or circular in shape. The debris removal mechanism 400 may further include one or more doors 403, one or more door actuators 407, a relay 404, and a sensor 405. In an embodiment, the door actuators 407 may selectively open or close the one or more doors 403 when a signal is received from the relay 404. The door actuators 407 may be one of a hydraulic cylinder, linear actuator, drive screw, or similar device. The relay 404 is communicatively coupled with the wired drill pipe string 401. The relay 404 may also be adapted to send and receive signals through the wired drill pipe string 401 with the surface. The relay 404 may be further adapted to interpret received signals which may indicate a request to open the one or more doors 403, for example. The sensor 405 may be, for example, a pulse echo type sensor, which may include a sonic pulse source and an echo detection unit. An operator or surface component may use the signals sent through the wired drill pipe string 401 by the sensor 405 to locate debris 406 within the wellbore 410. A variation from a baseline value of the signal sent by the sensor 405 may indicate that a piece of debris 406, such as for example articles of clothing, hand tools, and other objects from the rig running the well operations, has been located. In an embodiment, a characteristic signal of the sensor 405 may be associated with the debris 406. The characteristic signal, when observed, may indicate that the debris 406 has been located. Once the debris 406 has been found, the doors 403 may be opened to capture the debris 406. An additional sensor 408 coupled within the debris removal mechanism 400 may be used to indicate that the debris 406 has been captured within the internal volume 409. The doors 403 may then be closed in order to retain the debris 406 for removal.

Figure 5:
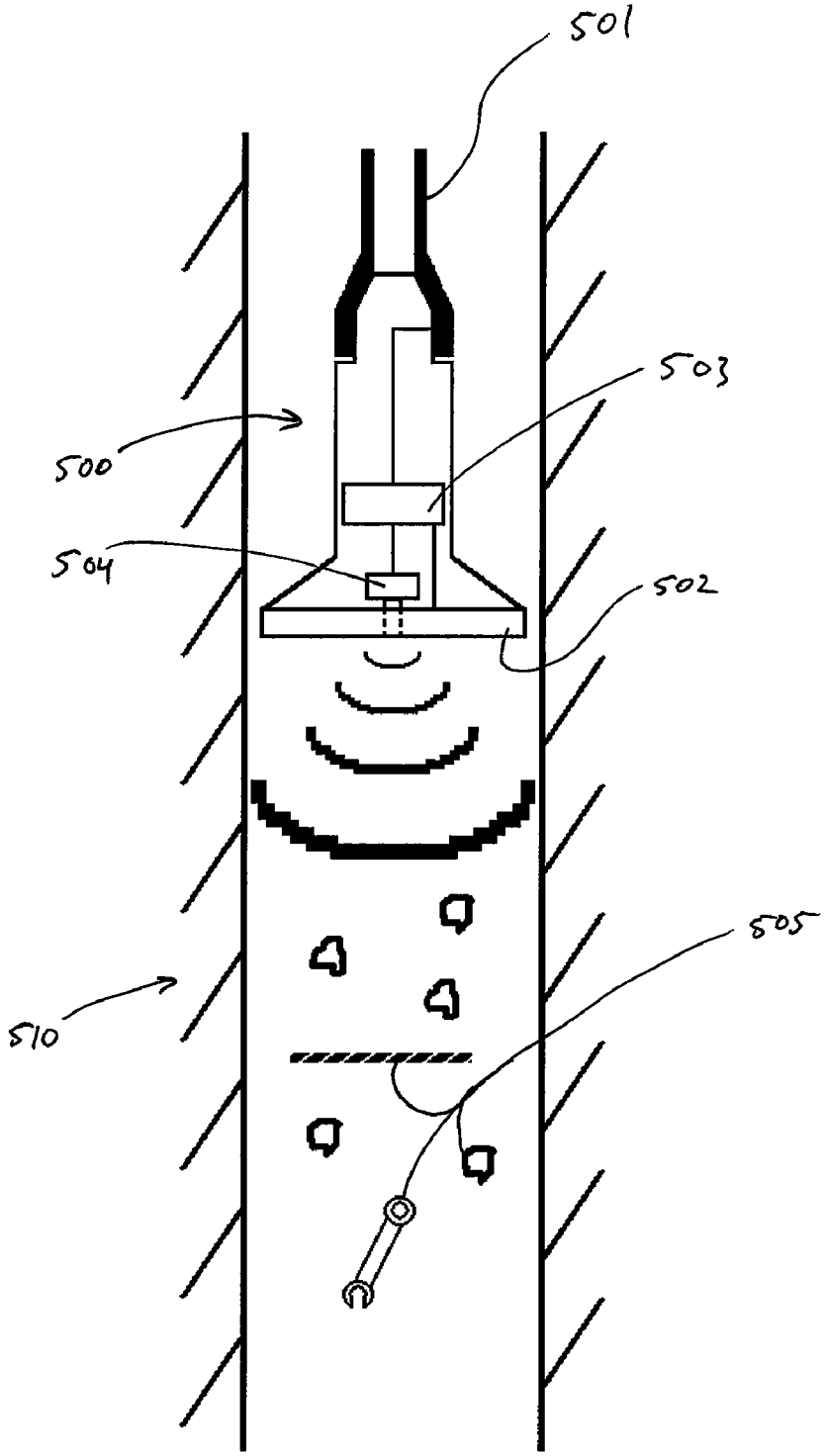
FIG. 5 is a partial cross sectional view of an embodiment of a magnetic debris removal mechanism.

FIG. 5 illustrates a partial cross section of an embodiment of a magnetic debris removal mechanism 500. The magnetic debris removal mechanism 500 may include a magnetic removal tool, such as an electro-magnet 502, a relay 503, and a sensor 504. The magnetic debris removal mechanism 500 may be coupled to a wired drill pipe string 501 for conveyance of the magnetic debris removal mechanism 500 through a wellbore 510. The relay 503 may be communicatively coupled with the wired drill pipe string 501 in order to send and receive signals with a surface component. In an embodiment, the sensor 504 may be a magnetic sensor which senses the presence of material that is attracted to magnetic fields. The magnetic debris removal mechanism 500 may be conveyed through the wellbore 510 with the electro-magnet 502 turned off until the sensor 504 senses the presence of debris 505. In an embodiment, the debris 505 may be detected and then the electro-magnet 502 may be switched on to capture the debris 505 and bring it up to the surface. The debris 505 may be any material that is attracted to magnetic fields, such as, for example, tool fragments, broken wireline, and hand tools that have fallen into the wellbore 510, among others. The relay 503 may be further adapted to interpret received signals which may indicate a request to turn on or off the electro-magnet 502.

Figure 6:
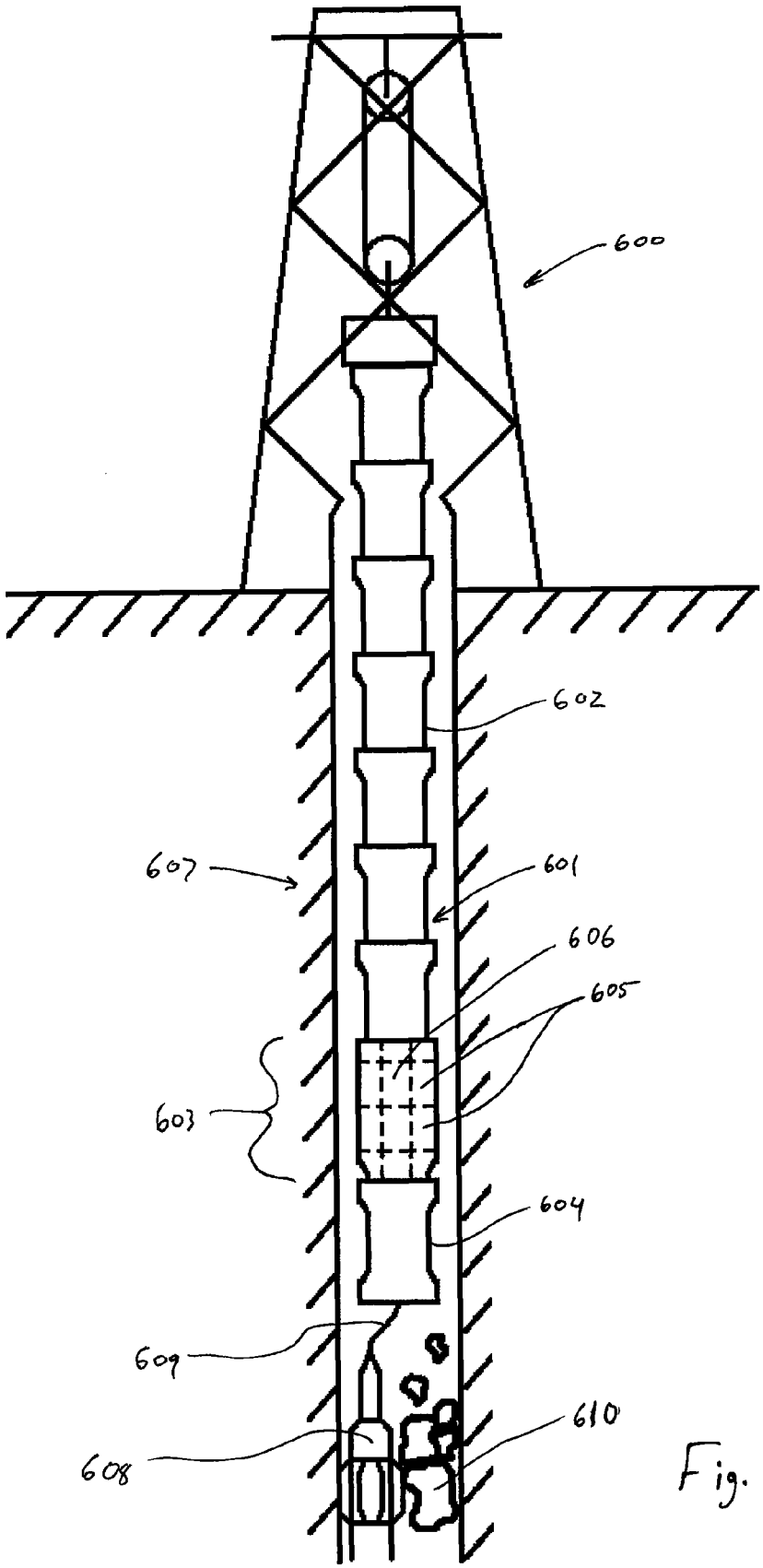
FIG. 6 illustrates an embodiment of a logging while fishing tool.

The devices and methods described above may be further enhanced with the use of a logging sub 603, as shown in FIG. 6. The logging sub 603 may consist of one or more logging/measurement instruments 605, formed into an assembly. Each instrument 605 may have a bore 606 formed therethrough. The bore 606 may provide a path for fluid to pass through. One end of the logging sub 603 may be coupled to a wired drill pipe string 601, and a fishing apparatus 604 may be coupled below the logging sub 603. The wired drill pipe string 601 may be coupled to a rig 600 for conveyance of the wired drill pipe string 601 into a wellbore 607. The wired drill pipe string 601 may consist of a number of wired drill pipe sections 602 coupled end to end. The logging sub 603 may be adapted to log characteristics of the wellbore 607 or formations about the wellbore 607. The logging sub 603 may be further adapted to take measurements during fishing operations by passing signals through the wired drill pipe string 601 to a surface component (not shown), such as a processor or data storage device. As shown, a tool string 608 may be stuck against a wall of the wellbore 607 by debris 610. The tool string 608 may be connected to a cable 609 for guiding the fishing apparatus 604 to the tool string 608. In an embodiment, the fishing apparatus may be the tool overshot 201 such as shown and described in reference to FIGS. 2A and 2B. The logging sub 603 may take measurements while the wired drill pipe string 601 is extended into the wellbore 607 so that the fishing apparatus 604 may retrieve the tool string 608.

While the foregoing is directed to embodiments of the present invention, other and further embodiments of the invention may be devised without departing from the basic scope thereof, and the scope thereof is determined by the claims that follow.

The invention claimed is:

1. A method of fishing with wired drill pipe comprising:

attaching a fishing apparatus to an end of a wired drill pipe string, the wired drill pipe string comprising a cable communicatively coupled at each pipe joint;

extending the wired drill pipe string into a wellbore; monitoring signals received through the wired drill pipe string from one or more sensors coupled to the fishing apparatus; and determining proper coupling of the fishing apparatus with one or more objects intended for removal based on the signals received from the one or more sensors.

2. The method of claim 1, wherein monitoring signals is performed using at least one of a strain gauge, a fluid pressure sensor, a multi-meter sensor, an electrical contact sensor, a physical contact sensor, a magnetic sensor or a sonar camera.

3. The method of claim 1, wherein the fishing apparatus comprises one of an overshot, a wireline grapple, an electromagnet, or a junk basket.

4. The method of claim 3, further comprising sending a signal through the wired drill pipe string which activates a feature of the fishing apparatus.

5. The method of claim 4, wherein activating a feature comprises one of engaging a grapple within the overshot, engaging a grapple mechanism of the wireline grapple, activating the electromagnet, or activating a door motion system of the junk basket.

6. The method of claim 1, wherein determining proper coupling comprises observing a change in the sensor signal which indicates proper coupling.

7. The method of claim 1, wherein the one or more objects intended for removal create a characteristic sensor signal identifying them as objects intended for removal.

8. A method of logging while fishing with wired drill pipe comprising:

coupling an overshot to the bottom of a wired drill pipe string, wherein the overshot is adapted to electrically couple with an end of a well logging instrument;

extending the wired drill pipe string into a wellbore;

physically coupling the overshot with a well logging instrument being fished from the wellbore such that the overshot is also electrically coupled with the well logging instrument being fished from the wellbore; and receiving signals through the wired drill pipe string from the well logging instrument being fished from the wellbore.

9. The method of claim 8, further comprising sending a signal through the wired drill pipe string which activates a feature of the overshot.

10. The method of claim 9, wherein activating a feature comprises engaging a grapple within the overshot.

11. The method of claim 8, further comprising determining proper coupling of the overshot with the well logging instrument being fished from the wellbore based on the signals received from one or more sensors coupled with the overshot.

12. The method of claim 11, wherein the sensors comprise at least one of a strain gauge, a fluid pressure sensor, a multimeter/electrical contact sensor (for electrical properties), a physical contact sensor, a magnetic sensor or a sonar camera.

13. The method of claim 11, wherein determining proper coupling comprises observing a change in the sensor signal which indicates proper coupling.

14. The method of claim 8, further comprising:

coupling a logging sub containing one or more well logging instruments between the wired drill pipe string and the overshot; and receiving signals from the logging sub through the wired drill pipe string while fishing the wellbore.

15. The method of claim 14, wherein the logging sub further comprises a bore adapted to allow fluid flow there through.

16. A system for fishing a wellbore, comprising:

a wired drill pipe string having a cable communicatively coupled at each pipe joint;

a fishing apparatus coupled to the wired drill pipe string; and one or more sensors coupled to the fishing apparatus which may send signals through the wired drill pipe string.

17. The system of claim 16, wherein the fishing apparatus comprises one of an overshot, a wireline grapple, an electromagnet, or a junk basket.

18. The system of claim 17, wherein the overshot has a grapple for engaging a tool, the wireline grapple has a grapple for engaging a cable, and the junk basket has one or more doors with door motion systems.

19. The system of claim 17, wherein the overshot contains a number of conductive pads and a tool which is engageable by the overshot has a spear containing a number of conductive contacts which are positioned and adapted to communicatively couple with the conductive pads of the overshot, and wherein the conductive pads are communicatively coupled with the wired drill pipe string.

20. The system of claim 16, wherein the one or more sensors consist of at least one of a strain gauge, a fluid pressure sensor, a multi-meter sensor, an electrical contact sensor, a physical contact sensor, a magnetic sensor or a sonar camera.

* * * * *